United States Patent [19]

Chambers et al.

[11] Patent Number: 4,940,429

[45] Date of Patent: Jul. 10, 1990

[54] REMOVABLE FILTER ARRAY FOR MULTI-WAY CONNECTORS

[75] Inventors: Jeffrey Chambers; Trevor Armistead; John C. Frodsham, all of Ulverston, England

[73] Assignee: Oxley Developments Company Limited, London, England

[21] Appl. No.: 338,724

[22] Filed: Apr. 14, 1989

[30] Foreign Application Priority Data

Apr. 26, 1988 [GB] United Kingdom ..... 8809854

[51] Int. Cl.[5] ..... H01R 23/06

[52] U.S. Cl. ..... 439/608

[58] Field of Search ..... 439/607-610, 439/620

[56] References Cited

U.S. PATENT DOCUMENTS 3,539,973 11/1970 Antes et al. ..... 439/608

3,569,915 3/1971 Sorensen et al. ..... 439/608

*Primary Examiner*—Joseph H. McGlynn

*Attorney, Agent, or Firm*—Pravel, Gambrell, Hewitt, Kimball & Krieger

[57] ABSTRACT

A multi-way connector assembly comprising a tubular metal outer casing and a plurality of electrical lead-through terminations which extend through the outer casing, the terminations carrying respective annular discoidal filter capacitors whose outer electrodes are connected electrically to a ground plane in the form of a metal plate which is itself connected electrically to the outer metal casing. The inner electrodes of the capacitor are electrically coupled to the associated lead-through terminations by respective contact clips which enable relative displacement of the capacitors and terminations for purposes of assembly and disassembly, the metal plate forming the ground plane being held in electrical connection with the outer casing by means of a removable locking means.

13 Claims, 3 Drawing Sheets

A
B
X
Y
10
12
14
16
18
19
20
22
22a
30
32
34
36
38
40
41
42
44
85

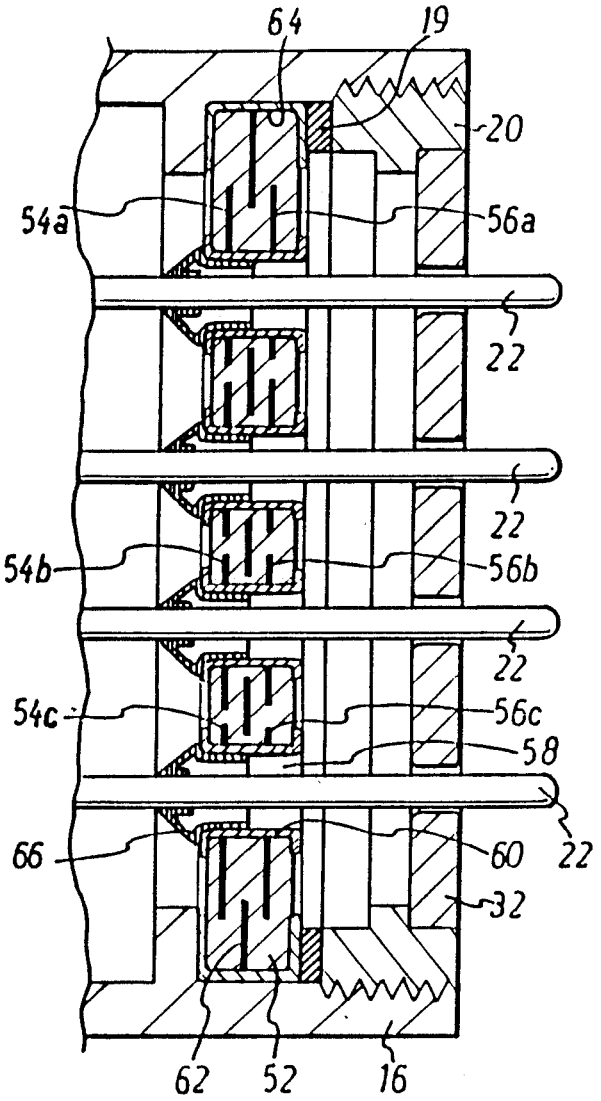
Fig 5
Fig 6
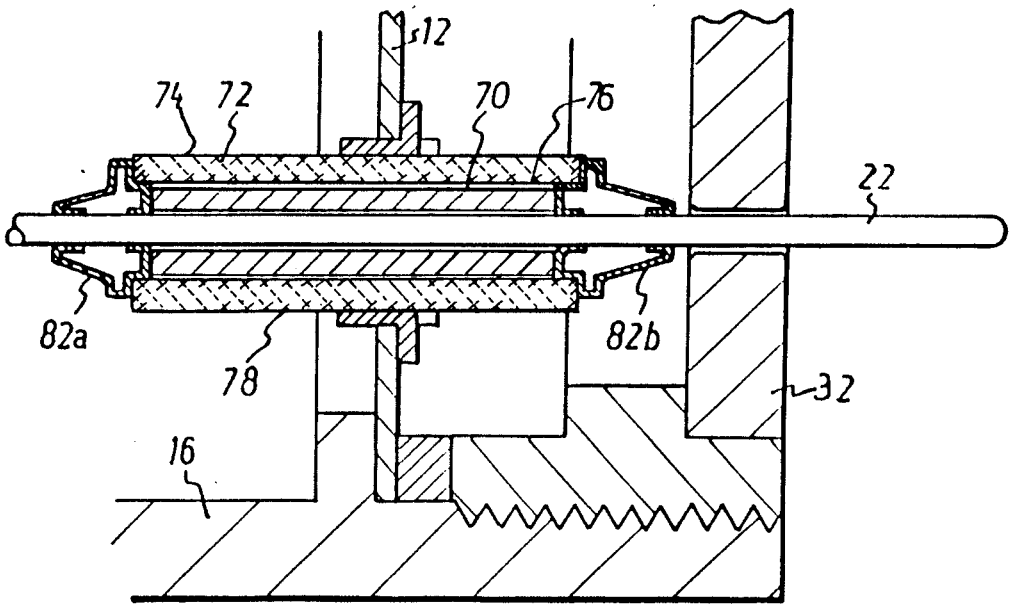

REMOVABLE FILTER ARRAY FOR MULTI-WAY CONNECTORS

BACKGROUND OF THE INVENTION

1. Field of the Invention

The present invention relates to multi-way connectors for electrical circuitry and is concerned in particular with the provision of a removable filter array in such multi-way connectors.

2. General Background of the Invention

In the provision of filter devices to suppress interference on signal and power lines, there are substantial advantages to be gained if the devices can be reliably incorporated within the confines of a multi-way connector. Not only does this utilise space most economically, but the filters have the shortest and therefore potentially the least impedance ground return path to provide the optimum filtering characteristics at high frequencies. This potential is only fully realised if the filters are grounded with a low resistance contact. The filters themselves should be protected from the environment and also from mechanical stresses imposed via the contact when the connector is mated and also via the rear terminations when the connector is soldered or otherwise connected to external circuitry.

It is known to incorporate a plurality of filter devices within a multi-way connector, using a ground plane in the form of a metal plate which has a plurality of through holes, each of which contains a respective annular filter capacitor whose outer electrode is soldered to the metal ground plane which is itself connected electrically and rigidly fixed to a metal outer casing of the connector. Each annular filter capacitor embraces and is soldered to a respective lead-through termination.

One problem with this known structure is that if any one of the filter capacitors breaks down or otherwise fails in use, then the whole connector becomes useless and must be discarded and replaced. This arises due to the fact that, once assembled, it is not practicable to dismantle the connector for repair purposes.

The same problem arises in embodiments where, instead of discrete discoidal annular filter capacitors, a planar array of capacitors is formed by a multilayer disc of ceramic having metal layers incorporated therewithin to form the capacitor electrodes, the multilayer structure having a plurality of axial holes connected to internal metal electrodes and soldered directly to connector pins inserted in the holes, with one common internal electrode forming an earth plane and being exposed at the periphery of the multilayer structure where it contacts the outer metal shell of the connector.

SUMMARY OF THE INVENTION

It is a principal object of the present invention to provide a multi-way connector which incorporates a filter array which can be removed easily for servicing and other purposes.

In accordance with the present invention, there is provided a multi-way connector assembly comprising a tubular metal outer casing and a plurality of electrical lead-through terminations which extend through the outer casing, the terminations being connected to respective filter capacitors having first electrodes formed by or connected electrically to a ground plane in the form of a metal plate which is itself connected electrically to the outer metal casing, characterised in that second electrodes of the capacitors are electrically coupled to the associated lead-through terminations by contact clips which enable relative displacement of the capacitors and terminations for purposes of assembly and disassembly and in that the metal plate forming the ground plane is held in a position providing electrical connection with the outer casing by means of a removable locking means.

In one embodiment, the capacitors are in the form of discrete annular discoidal filter capacitors having outer electrodes connected rigidly to the metal ground plane plate and inner electrodes which are electrically coupled to the associated lead-through terminations by respective contact clips.

Preferably, the contact clips comprise tubular elements having a plurality of inwardly biassed spring fingers for engaging the periphery of the lead-through terminations.

Preferably, the contact clips are soldered permanently to the inner peripheries of the associated discoidal capacitors.

In another embodiment, the capacitors are formed as a planar array in a multilayer ceramic disc having metal layers incorporated therein to form the capacitor electrodes, the multilayer structure having a plurality of axial holes communicating with internal metal electrodes and receiving respective contact clips which couple said internal metal electrodes to the associated lead-through terminations.

Advantageously, the locking means comprises a screw-threaded locking ring which is received within a correspondingly screw-threaded portion of the outer casing.

BRIEF DESCRIPTION OF THE DRAWINGS

The invention is described further hereinafter, by way of example only, with reference to the accompanying drawings, in which:

FIG. 5 is a sectional side view of part of a third embodiment; and

FIG. 6 is a sectional side view of part of a fourth embodiment.

DETAILED DESCRIPTION OF THE PREFERRED EMBODIMENTS

Figures 1, 1A, 1B:
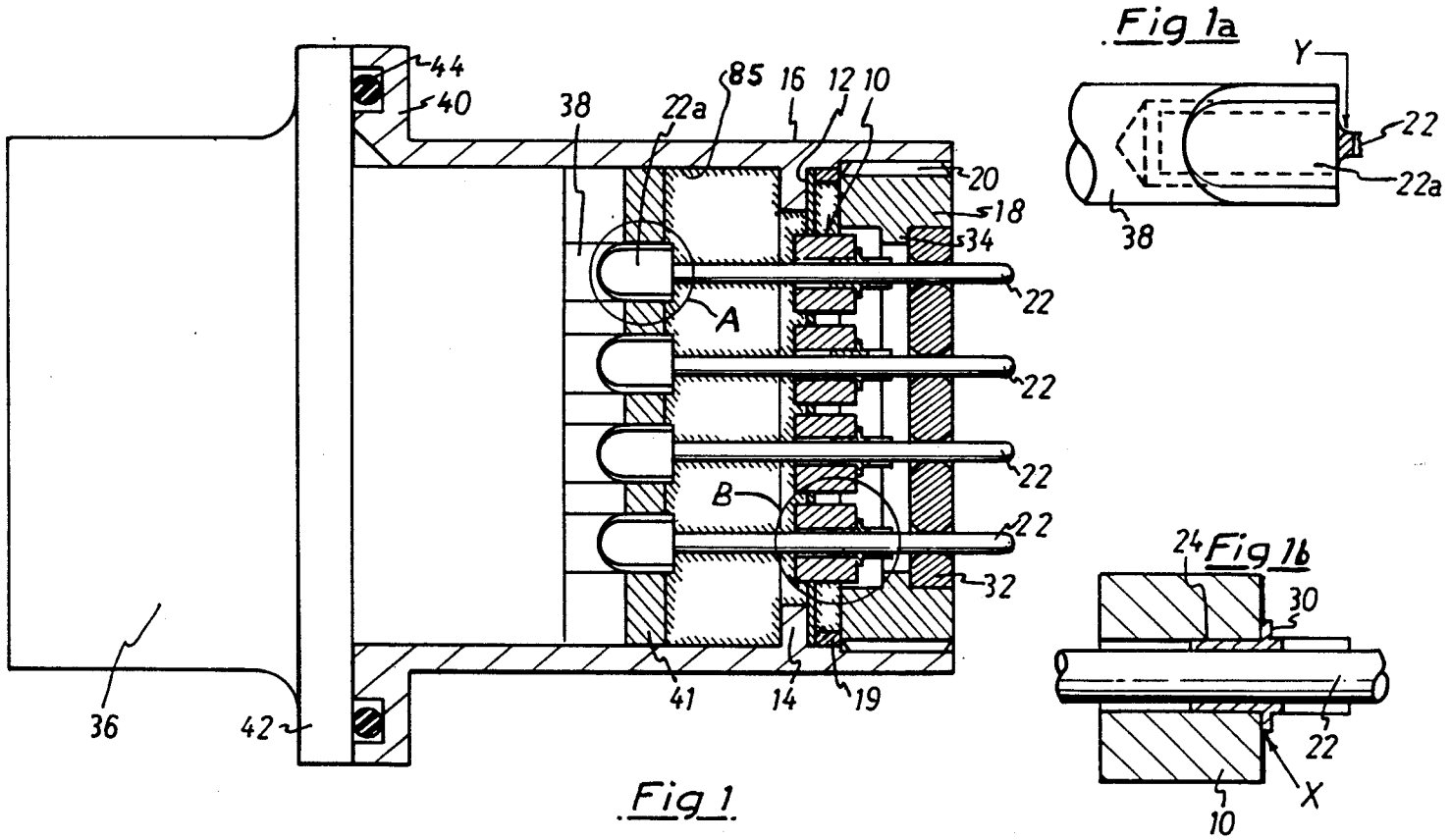
FIG. 1 is a side view, partially in section, of one embodiment of a multi-way connector in accordance with the present invention.
FIG. 1*a* is an enlarged detail of the part marked A in FIG. 1.
FIG. 1*b* is an enlarged detail of the part marked B in FIG. 1.

The multi-way connector illustrated in FIGS. 1, 1*a*, 1*b* and 2 comprises a planar array of discoidal, multilayer capacitors 10 each of which is soldered at its outer periphery within a respective aperture in a circular metal plate 12 forming a ground (earth) plane. One side of the outer periphery of the metal plate 12 is urged into close abutting relationship with an internal flange 14 on the inner periphery of a tubular metal casing 16 by means of a screw-threaded, annular locking ring 18 which is received within a correspondingly screw-threaded portion 20 of the metal casing. Preferably, there is disposed between the ground plane 12 and the locking ring 18 an annular spacer 19 made of any suitable material (conductive or non-conductive). By this means there is ensured a good electrical connection between the earth plane 12 and the outer casing 16.

Figure 2:
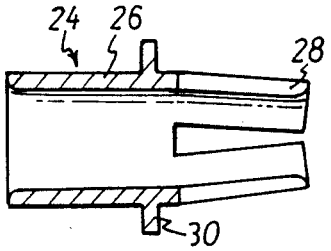
FIG. 2 is a longitudinal section through a spring clip used in the embodiment of FIG. 1.

The inner peripheries of the annular discoidal capacitors 10 each embrace a respective lead-through termination pin 22 and are electrically connected to the pins 22 by means of respective spring contact clips 24 as shown in the lower circled detail A in FIG. 1 (FIG. 1A). As shown in FIG. 2, each contact clip 24 comprises a tubular member 26 whose one end (right-hand end in FIG. 2) is longitudinally slotted to form a plurality of contact fingers 28 which are bent slightly inwardly so that they will firmly grip the periphery of a lead-through termination when pushed over same. The clips 24 also include an outwardly directed flange 30 which is used to solder the clips 24 to the capacitors 10 as indicated at X in FIG. 1*b*, with the cylindrical left-hand portions of the clips received snugly within the inner peripheries of the discoidal capacitors.

It will be appreciated that by virtue of the use of the clips 24, with the locking ring 18 and spacer 19 removed, the assembly comprised by the capacitors, clips and the ground plane can be slid along the lead-through terminations 22 for the purposes of assembly or of disassembly.

Referring again to FIG. 1, the free ends of the terminations projecting out of the casing 16 are guided by means of an apertured stiffening board 32 made of a hard plastics material, (e.g. phenolic) which is received with an interference fit within the inner periphery of the locking ring 18 so as to engage against an inwardly directed flange 34.

The stiffening board could also advantageously be positioned so that tapered counterbores in the holes therein bear upon the outer periphery of the contact fingers 28 to inwardly urge them against the termination pins 22. This could be used to lock the contacts to the termination pin for increased assurance of the pressure contact, particularly in severe vibrational environments.

The structure as so far described is adapted to be fitted to an existing connector device, such as a conventional multi-way circular connector 36 which provides at its left-hand end (as viewed in FIG. 1) a multi-pin male or female plug or socket arrangement and at its right-hand end a plurality of terminations 38 to which soldered joints would normally be made to connecting leads, component terminations and the like. In this case, the terminations 38 of the conventional multi-way circular connector are soldered at Y (see FIG. 1*a*) to enlarged (headed) ends 22*a* of the lead-through terminations 22, as shown in the upper circled detail A of FIG. 1. The tubular metal casing 16 embraces and snugly receives the right-hand end of the connector 36 and is joined to the casing 36 by rivetting a flange portion 40 on the casing 16 to a flange 42 on the connector 36. Preferably, there is disposed between the flanges, in an annular groove in the flange 40, an O-ring gasket 44 made of an electrically conductive material in order to improve the electrical connection between the metal casing 16 and the metal body of the connector 36.

A further stiffening board 41 of a hard plastics material embraces the right-hand ends of the terminations 38 in order to hold same in place.

Figure 3:
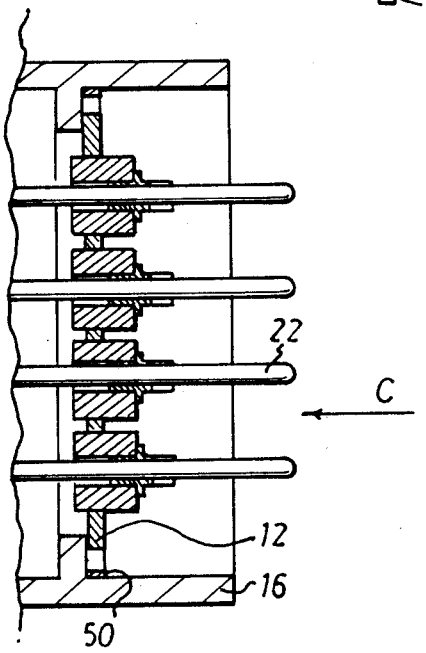
FIG. 3 is a sectional side view of part of a second embodiment, taken on the line III—III in FIG. 4.
Figure 4:
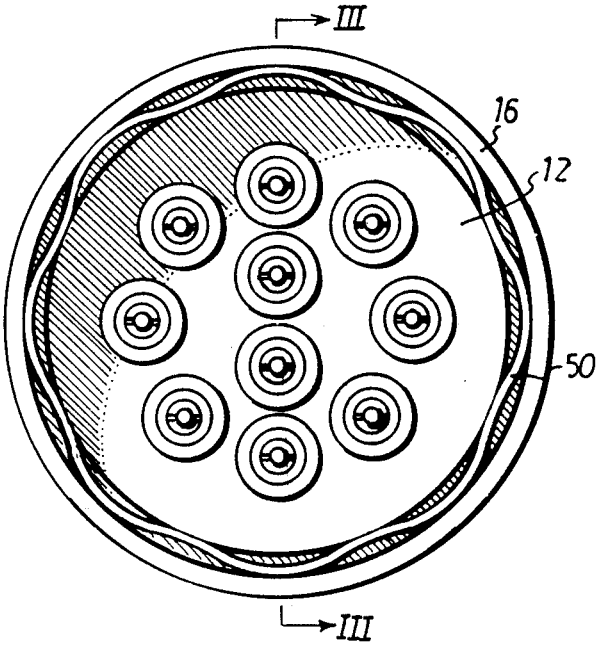
FIG. 4 is an end view of the second embodiment looking in the direction of arrow C in FIG. 3.

In an alternative embodiment illustrated in FIGS. 3 and 4, the locking ring 18 and spacer 19 can be replaced altogether or supplemented by a fixing clip in the form of a corrugated cylindrical member 50 which is mounted under compression between the outer periphery of the metal ground plate 12 and the inner periphery of the tubular casing 16. Such a clip ensures multi- point contact between the latter parts. The stiffening board 32 has been omitted from FIGS. 3 and 4 for clarity.

FIG. 5 illustrates a further embodiment of the type described in the introduction wherein, instead of discrete discoidal annular filter capacitors as in FIG. 1, a planar array of capacitors is formed by a multilayer disc of ceramic 52 having metal layers 54*a*,56*a*, 54*b*,56*b*; 54*c*,56*c*... incorporated therewithin to form the capacitor electrodes. The multilayer structure has a plurality of axial holes 58 containing respective metal sleeves or metallisations 60 which are electrically connected to the inner ends of the two metal layers 54,56 forming the capacitor electrodes. One further metal layer 62 common to all capacitors and forming the earth plane lies between the pairs of electrodes 54,56 and is connected at its outer periphery to a further sleeve or metallisation 64. The multilayer disc thus formed is fitted into the metal housing 16 of the connector in the same way as in FIG. 1, that is using the ring 19 and locking ring 20. A stiffening ring 32 can again be fitted over the free ends of the terminations 22.

The inner peripheries of the sleeves or metallisations 60 are connected electrically to the terminations 22 by means of respective spring clips 66. The clips 66 can be of the same shape as in FIG. 2 or, preferably, have the cross-sectional shape shown in FIG. 5. This allows the multi-layer disc to be withdrawn, with the clips 66, along the terminations for assembly and disassembly purposes.

In other embodiments, pi-section filters could be included, for example by adding a second set of capacitors 10 on a second earth plane 12 and mounting this second plane 12 outboard of the first capacitors on the lead-through terminations (see our co-pending U.K. Application No.8711998 for further details of the formation of such pi-section filters).

An alternative means of incorporating pi-section filters in accordance with the present invention and which requires only a single earth plane is shown in FIG. 6. Parts which are the same as in FIG. 1 are given the same reference numerals in FIG. 6. In this embodiment, each pi-section filter comprises an inner tube 70 of a ferrite material surrounded by an outer tube 72 of a ceramic material. Two areas 74,76 of metallisation are formed around spaced areas of the inner periphery and axial ends of the ceramic tube 72 to form first capacitor electrodes and a third area 78 of metallisation on the outer periphery of the ceramic tube 72 forms a common third electrode. The latter electrode 78 is connected electrically and rigidly to the earth plane via a metal bush 80 or simply by direct soldering. Disposed at each end of the above-described assembly is a respective metal spring clip 82*a*,82*b* whose one end is received tightly within the inner periphery of the ceramic tube 72 so as to be connected electrically to the metallisation 74(76) and also to hold the inner ferrite tube in place. The other end of each of the spring clips is adapted to grip the associated termination 22 in such a manner as to ensure electrical connection therewith whilst permitting the pi-section capacitor assembly to be moved along that termination for assembly and disassembly purposes, as in the case of the other embodiment described hereinbefore.

In some embodiments it is advantageous for the internal parts of the array to be conformally coated, as indicated at 85 in FIG. 1, with a flexible protective layer of a material such as polyurethane or epoxy. This provides the necessary environmental protection for the filter array whilst avoiding the thermally induced stresses associated with "bulk" encapsulation.

The abovedescribed construction has the advantages that:

(a) in the event of failure of any one or more of the capacitors or the soldered connections thereto, the filter array can be readily removed from the casing 16 merely by removing the locking ring and spacer or the wavy band 50 and then withdrawing the whole array along the terminations 22. It can then be replaced after suitable repair or replaced altogether by a new array;

(b) a range of standard connectors, such as the conventional multi-way circular connector 36, can be readily modified so as to incorporate a filter array by the connection thereto of the components 10 to 34. In practice, this would be built up by first soldering the lead-through termination pins 22 to the terminations 38 of the connector 36, applying the stiffening board 41, locating the outer casing 16 over the stiffening board and rivetting it to the flange 42 on the connector, applying the ground plane and capacitor assembly over the terminations 22 and locking the latter in place by means of the spacer and locking ring 18.

The term "tubular" as used herein includes hollow elongate bodies which are not necessarily of cylindrical section.

We claim:

1. In a multi-way connector assembly comprising a tubular metal outer casing and a plurality of electrical lead-through terminations which extend through the outer casing, the terminations carrying respective annular discoidal filter capacitors whose outer electrodes are connected electrically to a ground plane in the form of a metal plate which is itself connected electrically to the outer metal casing, the improvement wherein the inner electrodes of the capacitors are electrically coupled to the associated lead-through terminations by respective contact clips and which are adapted to enable relative displacement of the capacitors and terminations for purposes of assembly and disassembly and wherein the metal plate forming the ground plane is held in electrical connection with the outer casing by means of a removable locking means.

2. An assembly according to claim 1, wherein the contact clips comprise tubular elements having a plurality of inwardly biassed spring fingers for engaging the periphery of the lead-through terminations.

3. An assembly according to claim 2, wherein the contact clips are soldered permanently to the inner peripheries of the associated discoidal capacitors.

4. An assembly according to claim 3, wherein the locking means comprises a screw-threaded locking ring which is received within a correspondingly screw-threaded portion of the outer casing.

5. An assembly according to claim 4, wherein there is disposed between the metal plate forming the ground plane and the locking ring an annular spacer ring.

6. An assembly according to claim 3, wherein the locking means comprises a corrugated metal cylindrical clip which is spring loaded between the inner periphery of the outer casing and the outer periphery of the metal plate forming the ground plane.

7. An assembly according to claim 3, wherein the one ends of the terminations are soldered to respective further terminations mounted in a connector device whose outer periphery is received snugly within the outer casing.

8. As assembly according to claim 3, wherein the component surfaces disposed within the outer casing are provided with a conformed coating of a flexible protective material.

9. A multi-way connector assembly comprising a tubular metal outer casing and a plurality of electrical lead-through terminations which extend through the outer casing, the terminations carrying respective annular discoidal filter capacitors whose outer electrodes are connected electrically to a ground plane in the form of a metal plate which is itself connected electrically to the outer metal casing, wherein the inner electrodes of the capacitors are electrically coupled to the associated lead-through terminations by respective contact clips comprising tubular elements having a plurality of inwardly biassed spring fingers for engaging the periphery of the lead-through terminations, such as to enable relative displacement of the capacitors and terminations for purposes of assembly and disassembly and wherein the metal plate forming the ground plane is held in electrical connection with the outer casing by means of a removable locking means in the form of a screw-threaded locking ring which is received within a correspondingly screw-threaded portion of the outer casing.

10. A multi-way connector assembly comprising a tubular metal outer casing and a plurality of electrical lead-through terminations which extend through the outer casing, the terminations carrying respective annular discoidal filter capacitors whose outer electrodes are connected electrically to a ground plane in the form of a metal plate which is itself connected electrically to the outer metal casing, wherein the inner electrodes of the capacitors are electrically coupled to the associated lead-through terminations by respective contact clips comprising tubular elements having a plurality of inwardly biassed spring fingers for engaging the periphery of the lead-through terminations such as to enable relative displacement of the capacitors and terminations for purposes of assembly and disassembly and wherein the metal plate forming the ground plane is held in electrical connection with the outer casing by means of a removable locking means in the form of a corrugated cylindrical clip of metallic material which is spring loaded between the inner periphery of said outer tubular casing and the outer periphery of the metal plate forming the ground plane.

11. In a multi-way connector assembly comprising a tubular metal outer casing and a plurality of electrical lead-through terminations which extend through the outer casing, the terminations being connected to respective filter capacitors having first electrodes formed by a ground plane in the form of a metal plate which is itself connected electrically to the outer metal casing, the improvement wherein second electrodes of the capacitors are electrically coupled to the associated lead-through terminations by contact clips which are adapted to enable relative displacement of the capacitors and terminations for purposes of assembly and disassembly and wherein the metal plate forming the ground plane is held in a position providing electrical connection with the outer casing by means of a removable locking means.

12. An assembly according to claim 11, wherein the capacitors are formed as a planar array in a multilayer ceramic disc having metal layers incorporated therein to form the capacitor electrodes, the multilayer structure having a plurality of axial holes communicating with internal metal electrodes and receiving respective contact clips which couple said internal metal electrodes to the associated lead-through terminations.

13. A multiway-connector assembly comprising a tubular metal outer casing and a plurality of electrical lead-through terminations which extend through the outer casing, the terminations carrying respective pie-section filter arrays having capacitors whose outer electrodes are connected electrically to a ground plane in the form of a metal plate which is itself connected electrically to the outer metal casing, the capacitors of the pi-section filters having inner electrodes which are electrically coupled to the associated lead-through terminations by respective contact clips which are adapted to enable relative displacement of the capacitors and terminations for purposes of assembly and disassembly and wherein the metal plate forming the ground plane is held in electrical connection with the outer casing by means of a removable locking means, the capacitors being formed in pairs with respective inductors to form a plurality of said pi-section filter arrays, each such array comprising an inner tube of ferrite material and an outer tube of a ceramic material whose inner periphery carries two spaced areas of metallisation forming first and second capacitor electrodes and whose outer periphery carries a further area of metallisation forming a third capacitor electrode, the third electrode being connected rigidly to the earth plane and the first and second electrodes being coupled to the associated termination by respective contact clips.

* * * * *